United States Patent [19]

Shapiro et al.

[11] 3,930,894

[45] Jan. 6, 1976

[54] METHOD OF PREPARING COPPER BASE ALLOYS

[75] Inventors: Stanley Shapiro, New Haven; Michael J. Pryor, Woodbridge; Ronald N. Caron, Branford, all of Conn.

[73] Assignee: Olin Corporation, New Haven, Conn.

[22] Filed: Nov. 29, 1974

[21] Appl. No.: 528,149

Related U.S. Application Data

[62] Division of Ser. No. 445,447, Feb. 25, 1974.

[52] U.S. Cl. ..... 148/2; 29/527.7; 148/11.5 C; 148/12.7

[51] Int. Cl.[2] ..... C22F 1/08

[58] Field of Search ..... 148/2, 3, 11.5 C, 12.7, 148/13.2, 32, 32.5, 160; 29/527.7; 75/154

[56] References Cited

UNITED STATES PATENTS

| | | | |
|---|---|---|---|
| 2,059,555 | 11/1936 | Corson | 75/154 |
| 2,059,556 | 11/1936 | Corson | 75/154 |
| 2,059,557 | 11/1936 | Corson | 75/154 |
| 2,059,558 | 11/1936 | Corson | 75/154 |
| 2,128,955 | 9/1938 | Montgomery | 75/154 |
| 2,136,918 | 11/1938 | Hensel et al. | 75/154 |
| 2,210,670 | 8/1940 | Kelly | 75/154 |
| 2,636,101 | 4/1953 | De Pue | 75/154 |

FOREIGN PATENTS OR APPLICATIONS

| | | | |
|---|---|---|---|
| 445,620 | 4/1936 | United Kingdom | 75/154 |
| 793,409 | 11/1935 | France | 75/154 |
| 804,588 | 8/1936 | France | 75/154 |

*Primary Examiner*—C. Lovell

*Attorney, Agent, or Firm*—Robert H. Bachman; David A. Jackson

[57] ABSTRACT

An improved phosphor-bronze copper alloy having good hot workability and mechanical properties, and method of processing same. A preferred alloy contains from 2 to 11% tin, from 0.01 to 0.3% phosphorus, from 0.2 to 0.8% chromium and from 0.3 to 2.0% each of iron and/or cobalt.

6 Claims, No Drawings

METHOD OF PREPARING COPPER BASE ALLOYS

This is a division of application Ser. No. 445,447, filed Feb. 25, 1974.

BACKGROUND OF THE INVENTION

The phosphor-bronzes are copper base alloys containing phosphorus and tin. In this alloy system, alloys with phosphorus levels in excess of about 0.07 percent and tin contents in excess of about 4 percent exhibit poor hot workability. This is made manifest by rather pronounced cracking during hot rolling at moderately elevated temperatures. This "hot-shortness" is even more pronounced with increasing amounts of tin and phosphorus. Accordingly, alloys of this sytem are impractical to hot roll at normal commercial hot rolling temperatures.

Accordingly, it is a principal object of the present invention to provide improved copper base alloys of the phosphor-bronze type.

It is a particular object of the present invention to provide alloys as aforesaid which are hot workable at normal commercial hot working temperatures.

It is a still further object of the present invention to provide improved copper base alloys as aforesaid having good hot rollability combined with improved mechanical properties.

Further objects and advantages of the present invention will appear from the ensuing specification.

SUMMARY OF THE INVENTION

In accordance with the present invention it has been found that the foregoing objects and advantages may be readily achieved. The copper base alloy of the present invention consists essentially of: tin, from 2 to 11 percent; phosphorus, from 0.01 to 0.3 percent; a transition metal selected from the group consisting of zirconium, titanium, vanadium, chromium and mixtures thereof in an amount from 0.2 to 0.8 percent each; a material selected from the group consisting of cobalt, from 0.3 to 2.0 percent; iron, from 0.3 to 2.0 percent and mixtures thereof; balance copper, wherein the total of iron plus cobalt must be at least 0.8 percent. The grain size of the alloys is less than 0.010 mm and the alloy contains particulate phases uniformly dispersed throughout the matrix.

The present invention also represents an improved method of processing the aforesaid copper base alloys. The process of the present invention consists essentially of: casting a copper base alloy of the foregoing composition; homogenizing said alloy at a temperature of between 700°C and the solidus temperature of the alloy for at least 15 minutes; hot rolling said alloy at a starting temperature in excess of 650°C and up to within 50°C of the solidus temperature of the alloy, and at a finishing temperature in excess of 400°C; and cold rolling the alloy at a temperature below 200°C. Preferably the resultant material is subjected to a final heat treatment at a temperature between 100°C and 850°C for from 10 seconds to 8 hours. If desired, the cold rolling step may be conducted with or without intermediate annealing steps.

DETAILED DESCRIPTION

The composition of the copper base alloy of the present invention is as set forth hereinabove. Throughout the instant specification percentages of components are weight percentages.

The tin component is present in an amount from 2 to 11 percent. Greatest improvement is found in those alloys containing in excess of 4 percent tin since these alloys presented the most difficulty heretofore. The phosphorus content should vary between 0.01 and 0.3 percent, and preferably between 0.02 and 0.1 percent.

The alloy of the present invention contains a transition metal which may be either zirconium, titanium, vanadium and/or chromium in an amount from 0.2 to 0.8 percent each and preferably from 0.2 to 0.5 percent each, with chromium being preferred. In addition, the alloy of the present invention contains either iron or cobalt or both of these materials in an amount from 0.3 to 2.0 percent each, preferably from 1 to 2 percent each, with the minimum iron plus cobalt content being 0.8 percent. That is, either alone or in combination one must have at least 0.8 percent iron plus cobalt. This is necessary in order to obtain the proper cast structure for hot rolling. Iron and/or cobalt, together with the above transition metal, especially chromium, refines the cast grain structure and minimizes the formation of low melting Cu-P or Cu-P-Sn phases which normally impede hot rollability.

The balance of the alloy is essentially copper. Naturally, the present invention contemplates the inclusion of particular additional alloying ingredients in order to obtain particularly desired results. For example, one may include small but effective amounts of other elements such as beryllium, magnesium, silicon, aluminum, arsenic, antimony or lead in order to improve such properties as mechanical properties, corrosion resistance, processing characteristics, and machinability. Naturally, conventional impurities are also contemplated.

As indicated hereinabove, the alloy of the present invention has a fine grain size less than 0.010 mm which is obtained by the process of the present invention. This fine grain size greatly contributes to the improved properties obtained thereby. In addition, the microstructure is characterized by the presence of particulate phases uniformly dispersed throughout the matrix, the presence of which are insured by the processing of the present invention. One of these phases contains an iron and/or cobalt — transition metal (e.g., chromium) intermediate phase comprising a solid solution of iron and/or cobalt and transition metal. A second of said phases contains iron and/or cobalt — transition metal (e.g., chromium) phosphides. The phosphides could be stoichiometric or non-stoichiometric compounds. These phases are essential in obtaining the improved properties of the present invention.

The copper base alloy of the present invention may be cast in any convenient manner. The particular method of casting is not especially critical and any convenient commercial method may be employed, such as direct chill or continuous casting. The alloy should be homogenized following casting at a temperature between 700°C and the solidus temperature of the paraticular alloy associated with the particular composition. For example, an alloy containing 5 percent tin and 0.05 percent phosphorus which represents a particularly preferred composition has a solidus temperature of 950°C. The homogenizing procedure should be conducted for at least 15 minutes and generally less than 24 hours. The preferred homogenization temperature for the 5 percent tin alloy is from 800°C to 900°C for from 15 minutes to 4 hours.

The alloy is then hot rolled at a starting temperature in excess of 650°C and up to within 50°C of the solidus temperature of the particular composition. The finishing hot rolling temperature should be in excess of 400°C. It is a particular advantage of the present invention that the alloys may be conveniently hot rolled on a commercial basis. It is possible to hot roll the alloys of the present invention on a commercial basis without the formation of a liquid phase which often characterizes prior art phosphor-bronzes and which causes hot shortness.

The preferred hot rolling temperature range decreases with increasing tin contents. For example, an alloy of the present invention containing about 6 percent tin finds a preferred hot rolling temperature range of between 750°C and 900°C. This is particularly surprising since conventional phosphor-bronzes cannot be hot rolled practically above 800°C without cracking apart and being rendered useless. Furthermore, hot rolling these conventional materials at lower temperatures results in large scrap losses as well as high mill energy requirements.

The material is cold rolled following hot rolling to the desired final stage. One may cold roll directly to final gate with or without interannealing. If an intermediate annealing step is used between cold rolling passes, the material may be subjected to either strip or batch annealing techniques. Thus, for example, holding times of from 10 seconds to 24 hours may be used and temperatures of from 250°C to 850°C may be used. The final condition of the thus treated material may be either as temper rolled strip or heat treated strip.

The alloy of the present invention may be subjected to a final heat treatment step of from 10 seconds to 8 hours at temperatures between 100°C and 850°C in order to improve the yield strength and ductility characteristics.

It has been found in accordance with the present invention that the alloy of the present invention is characterized by ease of hot rollability, as stated hereinabove. In addition, the modified phosphor-bronze alloy of the present invention has mechanical properties superior to those of the base phosphorus-tin-copper composition. This strengthening effect apparent in the alloy of the present invention is a direct result of the solid solution strengthening, dispersion strengthening and precipitation strengthening which occur when the additives of the alloy of the present invention are added to the base composition. In addition to the foregoing, the iron and/or cobalt particles which are formed throughout the matrix of the alloy provide for grain refinement. Still further, these strengthening modifications in grain refinement are achieved with little or no detrimental effects in the bend formability or electrical conductivity of the base composition.

In addition to the foregoing, the alloy has improved stress corrosion resistance in ammoniacal environments over the standard phosphor-bronzes. For example, a representative alloy of the present invention in a U-bend, stress corrosion sample, was tested by exposure to moist ammonia and exhibited a life of 180 hours; whereas, a commercial phosphor-bronze Alloy 510 was tested under the same conditions and exhibited a life of 60 hours. This is an important property since these alloys find use in electrical applications where insulating materials tend to decompose to ammoniacal compounds.

The alloy and process of the present invention, as well as the improvements resulting therefrom, will be more readily apparent from a consideration of the following illustrative examples.

EXAMPLE I

An alloy of the present invention Alloy A, and a comparative, conventional commercial phosphor-bronze Alloy 510 were prepared having the compositions shown in Table IA, below. The alloys were cast from 1200°C into a steel mold with a water cooled copper base. The ingot of Alloy A was homogenized at 900°C for 2 hours followed by hot rolling at a starting temperature of 870°C and at a finishing temperature in excess of 400°C to 0.375 inch gage with a total reduction in the hot rolling pass of 79 percent. Alloy B was homogenized at 750°C for 2 hours and hot rolled from 725°C to 0.375 inch gage with a total reduction in the hot rolling pass of 79 percent. The alloys were then cold rolled to 0.120 inch gage. The tensile properties of the resultant materials are shown in Table IB below after annealing at 500°C for 2½ hours and as cold rolled using various reductions as shown in Table IB. For comparison purposes, the corresponding tensile properties of conventional phosphor-bronze Alloy B are shown in Table IB. As a further comparison another conventional comparative phosphor-bronze Alloy 510, Alloy C, was processed by cold rolling and annealing only since at the phosphorus-tin levels of Alloy C the material is not hot rollable. Table IB also shows the properties of Alloy C.

TABLE IA

| Alloy | Compositions Cu% | Sn% | P% | Fe% | Cr% |
|---|---|---|---|---|---|
| A | Balance | 5.8 | 0.1 | 1.0 | 0.5 |
| B | Balance | 4.4 | 0.07 | — | — |
| C | Balance | 5.2 | 0.08 | — | — |

TABLE IB

| Alloy | % Cold Reduction | Properties 0.2% Yield Strength (ksi) | Ultimate Tensile Strength (ksi) | Elongation (%) |
|---|---|---|---|---|
| A | 0 | 54 | 74 | 38 |
| B | 0 | 27 | 48 | 48 |
| C | 0 | 24 | 51 | 51 |
| A | 20.8 | 93 | 96 | 14 |
| B | 20.8 | 67 | 80 | 17 |
| C | 20.8 | 56 | 64 | 22 |
| A | 37.5 | 102 | 104 | 5.8 |
| B | 37.5 | 84 | 87 | 7.5 |
| C | 37.5 | 80 | 84 | 10 |
| A | 60.8 | 119 | 122 | 2.7 |
| B | 60.8 | 103 | 107 | 2.0 |
| C | 60.8 | 101 | 106 | 3.0 |
| A | 80.0 | 128 | 132 | 1.7 |
| B | 80.0 | 113 | 120 | 1.5 |
| C | 80.0 | 108 | 114 | 1.0 |
| A | 90.0 | 134 | 138 | 1.5 |
| B | 90.0 | 117 | 123 | 1.0 |
| C | 90.0 | 112 | 116 | 0.5 |

The foregoing tables clearly demonstrate the significant advantages obtained in accordance with the alloys of the present invention. In addition to the foregoing, Alloy A had a grain size of less than 0.005 mm; whereas, the grain sizes of commercial Alloys 510 ranged from 0.010 mm to 0.030 mm. Also, Alloy A was characterized by particulate phases uniformly distributed throughout the matrix as defined above.

EXAMPLE II

Alloys A and C were provided in the cold rolled form processed as in Example I. The bend characteristics of these alloys were compared at equivalent yield strengths and the results shown in Table II, below. The data compares the bend characteristics of each sample bent around mandrels of differing radii to determine the minimum bend radius of each sample for various yield strengths without failure by cracking of the sample. The values are reported in terms of the sharpest radius "R" which does not crack divided by the thickness "$t$" of the strip. The larger value of $R/t$ would signify poorer bend characteristics. The terms "longitudinal" and "transverse" refer to the relationship of the bend axis to the rolling direction. Longitudinal is the good way since the rolling direction is perpendicular to the bend axis, i.e., better bend characteristics are obtained. Transverse is the bad way since the rolling is parallel to the bend axis.

Alloy A of the present invention obtains substantially better bad way bends, while retaining acceptable good way bends. This is significant since phosphor-bronzes have notoriously poor bad way bends, while having excellent good way bends. The instant alloy retains acceptable good way bends, while surprisingly improving the bad way bends.

Note that no bend data is given for Alloy 510 at 120 ksi yield strength since this alloy cannot generally be processed to so high a yield strength.

TABLE II

| Alloy | 0.2% Yield Strength (ksi) | Longitudinal R/t | Transverse R/t |
|---|---|---|---|
| A | 70 | 0.4 | 0.6 |
| C | 70 | 0.3 | 0.8 |
| A | 80 | 0.8 | 1.0 |
| C | 80 | 0.4 | 2.4 |
| A | 90 | 1.4 | 1.8 |
| C | 90 | 0.4 | 4.4 |
| A | 100 | 2.4 | 3.4 |
| C | 100 | 0.6 | 8.0 |
| A | 110 | 4.0 | 7.0 |
| C | 110 | 2.0 | 15.0 |
| A | 120 | 5.6 | 12.0 |
| C | 120 | — | — |

EXAMPLE III

An alloy of the present invention, Alloy D, was prepared having a composition as follows: iron — 0.7%; cobalt — 0.4%; tin — 5.5%; chromium — 0.4%; phosphorus — 0.1%; copper — balance. The alloy was processed in a manner after Example I and was characterized by comparable properties and characteristics.

This invention may be embodied in other forms or carried out in other ways without departing from the spirit or essential characteristics thereof. The present invention is therefore to be considered as in all respects illustrative and not restrictive, the scope of the invention being indicated by the appended claims, and all changes which come within the meaning and range of equivalency are intended to be embraced therein.

What is claimed is:

1. A method of preparing wrought copper base alloys having good hot rollability, good stress corrosion resistance, good strength properties and good bend characteristics which comprises:

A. casting a copper base alloy having the composition consisting essentially of: tin from 2 to 11 percent; phosphorus from 0.01 to 0.3 percent; a transition metal selected from the group consisting of chromium, zirconium, titanium, vanadium and mixtures thereof in an amount from 0.2 to 0.8 percent each; a material selected from the group consisting of iron from 0.3 to 2.0 percent, cobalt from 0.3 to 2.0 percent, and mixtures thereof, wherein the total iron plus cobalt must be at least 0.8 percent, balance copper;

B. homogenizing for at least 15 minutes at a temperature between 700°C and the solidus temperature of the alloy;

C. hot rolling at a starting temperature in excess of 650°C and up to within 50°C of the solidus temperature, and at a finishing temperature in excess of 400°C; and D. cold rolling the material, thereby obtaining a copper base alloy having a grain size less than 0.010 mm and containing particulate phases uniformly dispersed throughout the matrix thereof, wherein a first of said phases contains an iron and/or cobalt-transition metal intermediate phase comprising a solid solution of said iron and/or cobalt plus transition metal and wherein a second of said phases contains iron and/or cobalt-transition metal phosphides.

2. A method according to claim 1 wherein said alloy is subjected to a final heat treatment at from 100°C to 850°C for from 10 seconds to 8 hours.

3. A method according to claim 1 wherein the material is cold rolled in step (D) with intermediate anneals.

4. A method according to claim 1 wherein said alloy is homogenized in step (B) for from 800°C to 900°C for 15 minutes to 4 hours.

5. A method according to claim 3 wherein said intermediate anneals are at a temperature from 250°C to 850°C for from 10 seconds to 24 hours.

6. A method according to claim 1 wherein said transition metal is chromium.

* * * * *